United States Patent [19]

Stein

[11] Patent Number: 4,494,499

[45] Date of Patent: Jan. 22, 1985

[54] SYSTEM AND APPARATUS PROVIDING A TWO STEP STARTING CYCLE FOR DIESEL ENGINES USING A PNEUMATIC STARTER

[75] Inventor: Robert A. Stein, Dayton, Ohio

[73] Assignee: Tech Development Inc., Dayton, Ohio

[21] Appl. No.: 492,940

[22] Filed: May 9, 1983

[51] Int. Cl.[3] ..... F02N 17/00

[52] U.S. Cl. ..... 123/179 F; 123/179 R; 60/627

[58] Field of Search ..... 123/179 F, 179 A, 179 R; 60/625, 627, 630

[56] References Cited

U.S. PATENT DOCUMENTS

| | | | |
|---|---|---|---|
| 2,953,127 | 9/1960 | Adams et al. | 123/179 F |
| 3,104,659 | 9/1963 | Smith | 123/179 F |
| 3,307,349 | 3/1967 | Brelen | 123/179 F |
| 3,722,209 | 3/1973 | Kaytor | 60/627 |
| 3,823,701 | 7/1974 | Tuji | 123/179 R |
| 4,305,002 | 12/1981 | Mortensen | 123/179 R |

FOREIGN PATENT DOCUMENTS

| | | | |
|---|---|---|---|
| 0774089 | 5/1957 | United Kingdom | 123/179 F |

*Primary Examiner*—Parshotam S. Lall
*Attorney, Agent, or Firm*—Jerome P. Bloom

[57] ABSTRACT

A system for obviating chance damage in starting a diesel engine due, for example, to hydraulic lock utilizes a two step starting cycle and includes means for applying power to initiate and maintain a drive of the engine for starting thereof and associated controls rendered operative on a drive of the engine to sense the speed of crankshaft rotation and interrupt said application of power in response to a pre-set speed thereof which is substantially less than that required to start the engine to induce thereby a reduction of said speed and in response to such reduction a reapplication of said power. A portion of said controls is conditioned to automatically respond to a predetermined extent of rotation of the engine crankshaft to nullify ability of the controls to thereafter functionally interfere with the engine drive, whereupon there is an increase in the speed of crankshaft rotation to a level sufficient to induce a starting of the engine and its normal operation. This system is enhanced in its application to a preferred embodiment of the invention featuring a pneumatic starter. In this embodiment delivery of fluid under pressure, the source of power to energize the starter and crank the engine until it starts, is controlled to insure the speed of crankshaft rotation during the initial phase of starting is maintained below the aforementioned pre-set level until the crankshaft has revolved at least 360°.

12 Claims, 2 Drawing Figures

Figure 1:
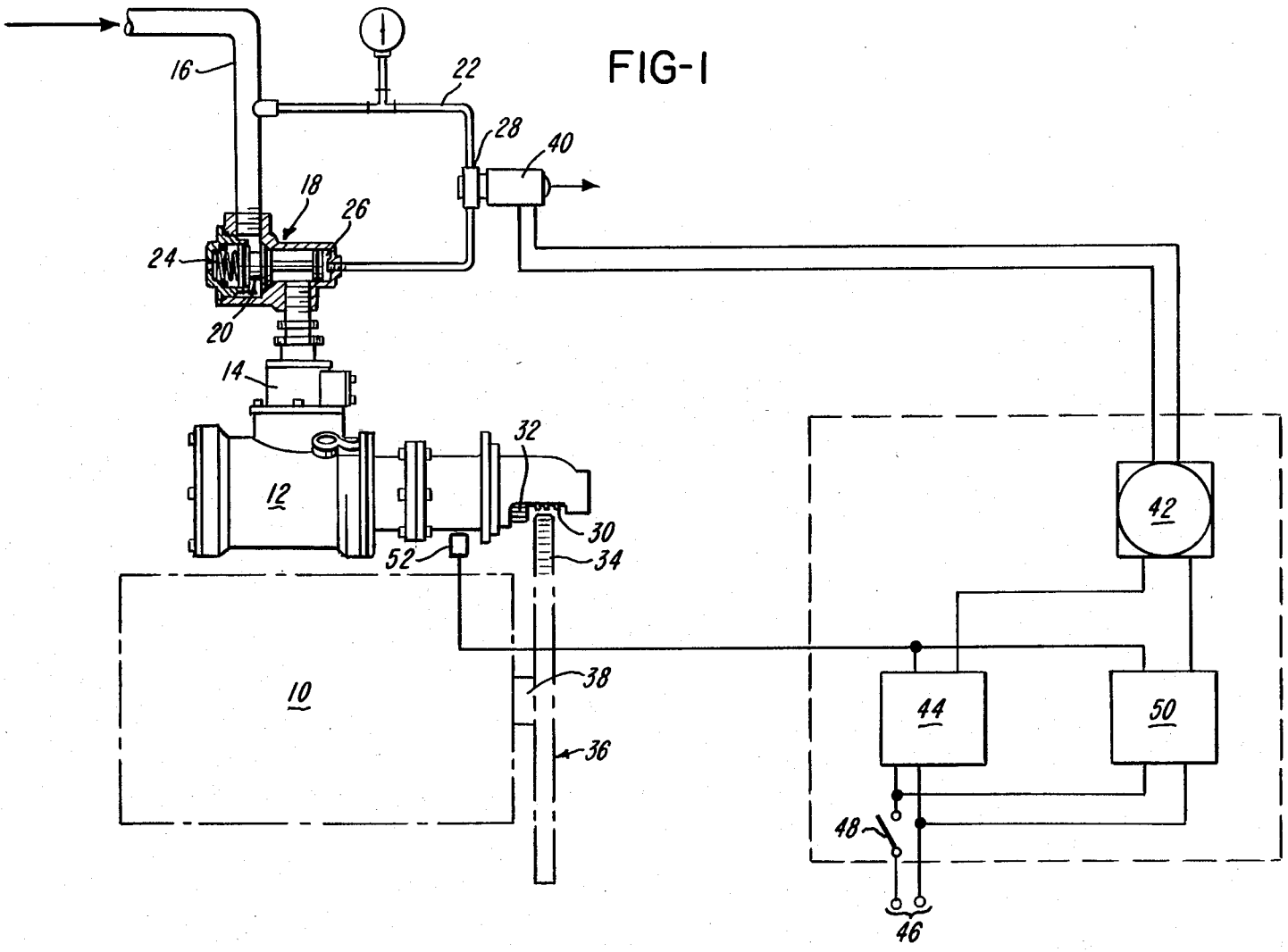

SYSTEM AND APPARATUS PROVIDING A TWO STEP STARTING CYCLE FOR DIESEL ENGINES USING A PNEUMATIC STARTER

BACKGROUND OF THE INVENTION

This invention relates to the art of starting diesel engines.

A problem which frequently presents itself in use of diesel engines derives from the fact that liquids such as water, fuel or coolant tend to accumulate in their cylinders when the engine is shut down. If the amount of liquid accumulated is in any case sufficient to fill the cylinder clearance volume, hydraulic lock and damage can occur on starting the engine. As a matter of fact there have been many instances where attempts to start a diesel engine under adverse conditions the extent of which was not fully comprehended have resulted in serious engine damage. Problems of this nature have existed and been a matter of serious concern for an extended period of time.

A most satisfactory and adequate solution to the stated problem is provided by the present invention, preferred embodiments of which feature the use of a pneumatic starter and are simple to fabricate, most efficient and satisfactory in operation, unlikely to malfunction and highly protective of the engine to which they apply.

The inventor has no present knowledge of any prior art which is specifically pertinent to the present invention or its features of novelty.

SUMMARY OF THE INVENTION

Embodiments of the present invention provide a two step starting cycle for a diesel engine. As herein illustrated, the engine is provided with a pneumatic starter to furnish its original motive power and the gas delivery line of the starter is provided with a pneumatic relay valve which is normally closed to block a flow therethrough of the gaseous fluid required to power the starter. This apparatus is provided with a circuit for controlling its operation the use of which insures that, once that it has achieved its starting speed, the starting of the engine will be free of chance damage by reason of hydraulic or other blockage. The closing of a main switch in the control circuit, as herein contemplated, is effective to energize a slave solenoid the operation of which results in a flow of pressure fluid to open the pneumatic relay valve and provide for a flow of gaseous fluid therethrough to energize the starter. The starter correspondingly then engages and commences a rotation of the engine crankshaft through its flywheel in a conventional manner. However, as limited by its control circuit, during the first step of its starting cycle, the speed of rotation of the engine crankshaft is kept below that required to effectively start the engine for a sufficient period of time to insure against the occurrence of hydraulic or other blockage upon bringing the engine to full starting speed for the second step of its starting cycle.

In accordance with a preferred method and practice of the invention, the cranking speed of the engine is limited during the first step of the starting procedure to no more than one-fourth of that normally prescribed for this purpose. To achieve such control the system of the invention embodies means to sense the speed of rotation of the engine crankshaft, preferably through the medium of a scanning of the teeth of the ring gear peripheral to the engine flywheel, and to interrupt the delivery of gaseous fluid to power the starter by a deenergizing of the slave solenoid at that point the speed of rotation of the crankshaft reaches one-fourth its conventional cranking speed. Since this prescribed speed limit is reached very rapidly, by this point in time the crankshaft will have rotated only a small fraction of the first 360° of its revolution. With the interruption of the flow of gaseous fluid to power the starter, the speed of rotation of the engine flywheel, and correspondingly the connected crankshaft, will decay and reduce rapidly. This reduction in speed of rotation will be immediately sensed and signals thereof will be transmitted as in the first instance the consequence of which is to energize the slave solenoid once more, thereby to produce another pulse of gaseous fluid to power the starter and continue the drive of the engine crankshaft. Once started, procedure will be repeated each time the speed of rotation of the engine crankshaft rises to and subsequently falls below the prescribed limit until there has been a 360° revolution of the crankshaft, at which point in time there will be an override of the speed limit controls by virtue of which the starter will be continuously supplied with pressure fluid to furnish its motive power so that it may effect a drive of the engine crankshaft at a level of speed which corresponds to its conventionally prescribed cranking speed.

All the while that the control circuit is functioning, the speed of the crankshaft is sensed by observation of increments of its rotation and there is a dual transmission of the resultant signals. In the one case the signals are routed to a counter. In the other case the signals are routed to a speed switch wherein the frequency thereof is used to determine the engine speed, which is continuously compared to means defining a preset limit. When the signals indicate a reaching of the preset speed limit, the circuit of the slave solenoid is opened and the solenoid deenergized to briefly interrupt the delivery of pressure fluid to the starter. When the frequency of the signals received by the speed switch indicate a speed of the rotation of the engine crankshaft below the limit, the solenoid circuit is closed to once more open the pneumatic relay valve and provide for a further delivery of pressure fluid to power the starter. Inherently the opening and closing of the valve 18 occurs in such rapid sequence during a 360° rotation of the crankshaft that the effect thereof is to produce a pulsed delivery of the gaseous fluid to power the starter. At such time as the counter receives a prescribed number of signals to correspond to a 360° rotation of the engine crankshaft, an override device functions. The latter nullifies the ability of the control circuit to further interfere with the delivery of gaseous fluid to power the starter. As a result, the starter output rises to and maintains its prescribed level which is necessary to achieve the rotational speed of the crankshaft required to start the diesel engine.

A primary object of the invention is to provide a new and improved system for and method of insuring against chance damage to a diesel engine during a starting procedure.

Another object is to provide a new and improved system for starting a diesel engine featuring controls which automatically function to provide it with a two step starting cycle, the first of which provides for the cranking of the engine crankshaft at a speed of rotation which does not exceed a fraction of that required for starting the engine and the second of which provides for a rotation of the crankshaft at its prescribed starting speed.

A further object is to provide a new and improved system for starting a diesel engine having a pneumatic starter which provides for a pulsed delivery of gaseous fluid, under pressure, to power said starter for a limited period of time at a level such that the output thereof is insufficient to rotate the engine crankshaft at a speed that is more than a fraction of that required to start the engine and thereafter provides for a continuous delivery of the fluid under pressure to power the starter sufficiently to produce an output thereof which increases the speed of rotation of the crankshaft to that required for starting the engine.

An additional object is to provide a method of starting a diesel engine comprising the steps of energizing the crankshaft of the engine to produce a rotation thereof the extent of which is at least 360° and during such rotation limiting the speed of rotation of the crankshaft to a fraction of that required to start the engine and subsequently establishing and maintaining the rotational speed of the crankshaft at the level required for a starting of the engine.

A further object is to provide a method of starting a diesel engine having a pneumatic starter comprising the steps of producing a pulsed flow of fluid under pressure to energize the starter and produce a rotation of the crankshaft of the engine the extent of which is at least 360° and during such rotation to limit the output of said starter so that the speed of rotation thereof does not exceed approximately one-fourth of that which is required to start the engine and thereafter providing a continuous flow of said fluid under pressure to power the starter and produce an output thereof the level of which is that required for a starting of the engine.

Another object of the invention is to provide a new and improved system for starting a diesel engine having a pneumatic starter powered by gaseous fluid under pressure featuring a device for sensing the speed of rotation of the engine crankshaft when driven by the starter, means responsive thereto operative to selectively interrupt the delivery of the gaseous fluid which powers the starter, to maintain for a period of time an output of said starter which is insufficient to rotate the crankshaft at a speed more than a fraction of that required to start the engine, and means automatically responding to a predetermined degree of rotation of the engine crankshaft to terminate interruption of the delivery of gaseous fluid to the starter, leaving the starter free to perform its starting function.

A further object of the invention is to provide a new and improved means for and method of starting a diesel engine posessing the advantageous structural features, the inherent meritorious characteristics and the means and mode of application herein described.

With the above and other incidental objects in view as will more fully appear in the specification, the invention intended to be protected by Letters Patent consists of the features of construction, the parts and combinations thereof and the mode of operation as hereinafter described or illustrated in the accompanying drawings or their equivalents.

Figure 2:
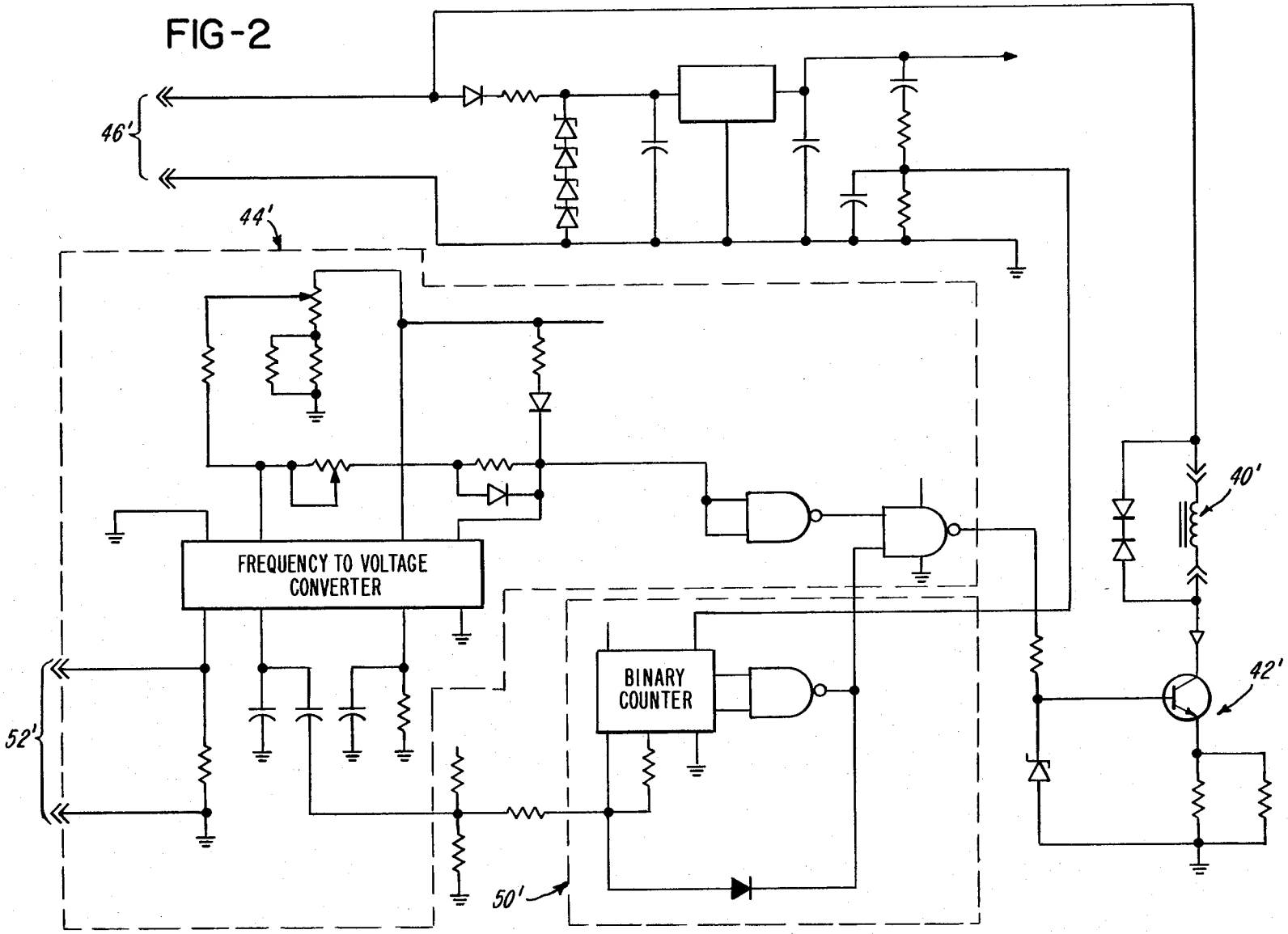

Referring to the drawings wherein some but not necessarily the only forms of embodiment of the invention are illustrated, FIG. 1 is a generally diagrammatic view of one system for starting a diesel engine per the present invention, and FIG. 2 is a schematic of a solid state control circuit which may be employed in the system of FIG. 1.

FIG. 1 shows a diesel engine 10 provided with a pneumatic starter 12 including an air inlet 14. The starter 12 is powered by a pressured flow of gaseous fluid delivered to and through its inlet by way of a conduit 16 and a pneumatic relay valve 18. The discharge end of the conduit 16 is connected to the inlet of the valve and the outlet of the valve is connected to the air inlet 14.

Valve 18 is normally closed, a contained valving element 20 being biased therein to a position in which it normally blocks upstream gaseous fluid from moving through the valve to the inlet of the pneumatic starter.

A small bore by-pass tube 22 has one end thereof connected to open into the conduit 16 upstream of the valve inlet and its opposite end connected to open to a chamber 26 in the valve. One wall of the chamber 26 is defined by one end of the valving element 20, the opposite end of which has applied thereto a spring 24 which normally biases the element 20 into that position in which it blocks the flow passage which extends between the valve inlet and the valve outlet and thereby closes the valve 18.

Inserted in the tube 22, intermediate its ends, is a control valve 28. The valve 28 is a three way valve which is normally closed to prevent pressure fluid from moving from the conduit 16 to the chamber 26. At the same time the setting of the valve provides for a venting of both the downstream portion of the tube 22 and the chamber 26 to the atmosphere.

As herein illustrated, the starter 12 is one manufactured and sold by Tech Development Inc. of Dayton, Ohio having a model designation TDI 52R-12. For full details thereof reference is made to the disclosure of pending application for U.S. patent Ser. No. 06/339,134 filed Jan. 13, 1982 for "Systems for greater utilization of available sources of energy", now abandoned. The starter 12 embodies a transmission powered by a turbine rotor (not shown) which is energized, when the valve 18 is in an open condition, by the application thereto of the fluid delivered by way of the conduit 16 and valve 18 to the inlet 14. Once the starter 12 is powered, the energy so produced is directed through an output shaft 30 distinguished by a helical thread having a relatively high lead angle and threadedly engaged by an output pinion 32 having a complementary internal thread. The pinion 32 is normally positioned at the innermost end of the shaft 30 at such time as the turbine rotor of the starter is first energized. As the turbine rotor is brought from a position of rest to a required speed of rotation, the shaft 30 will be brought up to its own corresponding operating speed. Due to the construction and interrelation of the pinion 32 and the shaft 30 the inertia of the pinion 32 will cause it to initially resist acceleration to the speed of rotation of the shaft 30. As a result the pinion will move axially and outwardly along the shaft 30 and assume the shaft rotational speed only at such time it reaches the outer end portion of the shaft.

As the pinion 32 is translated to the outermost end of the shaft 30, by reason of its appropriate alignment it will be brought into a meshing engagement with the teeth of a ring gear 34 forming the outer peripheral part of the flywheel 36 of the engine 10 which is fixed in a driving relation to the engine crankshaft 38.

The valve 28 is a solenoid slave valve and under the control of a solenoid 40. When energized the solenoid 40 produces an opening of the valve 28.

The solenoid 40 is connected to a control circuit by way of a relay or solenoid driver 42 and through a speed switch 44 to a power supply 46. The circuit is completed by closing a main switch 48 in a line extending between the power supply and the speed switch. A counter 50 in connection with the relay 42 is connected to the power supply through a closing of the switch 48.

In a system of the invention as shown in FIG. 1, a speed pick-up device 52 is mounted on and in connection with the housing of the starter 12 in a position to continuously scan a point in a circular path through which the teeth of the ring gear 34 must pass at such time as the starter 12 is powered sufficiently to couple its output pinion 32 in a cranking and driving engagement to the flywheel 36 and the engine crankshaft 38.

The speed pick-up device 52 is embodied in and forms a part of the aforementioned control circuit. It is connected to both the speed switch 44 and the counter 50 to simultaneously transmit thereto a signal (pulse) each time a tooth of the ring gear 34 passes through its line of sight, once power is provided for the control circuit by a closing of the main switch 48.

The speed switch 44 embodies, in connection therewith, means to measure the time lapse between successively adjacent pulses received thereby and compare it to a pre-set point reference, the latter being adjustable in accordance with the requirements of the application of the control circuit. This comparison determines whether the speed of rotation of the engine crankshaft, as represented by the time spacing and correspondingly the frequency of the pulses delivered from the speed pick-up device 52, is under, at or above a pre-set speed limit which is represented by the set point reference. The circuitry of the speed switch is wired, in the case of the present embodiment, to open the line to the solenoid 40 and cause it to be deenergized when the speed of rotation of the engine flywheel and thereby the engine crankshaft reaches or exceeds a pre-set limit.

The counter 50 has the circuitry thereof connected and arranged to count the signals transmitted by the speed pick-up sensor device 52 and, upon the sensing of a pre-set number of degrees of rotation of the engine crankshaft, as is represented by the receipt of a pre-set number of signals, apply an override to the circuitry of the speed switch to the extent of negating its ability to further cause an opening of the circuit energizing the solenoid 40.

By way of example, but not by way of limitation a Red Lion Model 300 speed switch may be employed to provide the switch 44 and a Red Lion CA 400 P electronic Presettable Counter may be used in providing the counter 50.

Thus, one embodiment of the invention is shown in FIG. 1 the preferred form and setting of which as well as a method of starting a diesel engine in the use thereof is as follows.

In establishing the system of FIG. 1 in accordance with a preferred embodiment of the invention and practice thereof, a basic premise is to keep the speed at which the engine is initially cranked, during a predetermined period of the starting procedure, well below the normal starting speed of the engine. In a most preferred embodiment of the invention the cranking speed of the engine is initially limited to no more than one-fourth the speed at which the engine will normally start. The extent of rotation of the engine crankshaft at a speed below starting speed need not be appreciably more than 360°, after which the engine crankshaft can be driven at the prescribed starting speed to bring the engine into its normal operation, thus inducing an automatic disengagement of the pinion 32 from the engine flywheel.

To summarize, a full starting cycle for a diesel engine using the foregoing system, in its most preferred embodiment, requires as a first step a closing of the switch 48. The switch 48 may have the form of a push button, or its equivalent, spring biased, to a normally open condition. As the switch 48 is closed, a circuit is completed to energize the solenoid 40 and open the valve 28. As the valve 28 is opened, fluid under pressure is directed into the chamber 26 of the valve 18 by way of the tube 22 to produce a displacement of the valving element 20 to open the valve. Fluid under pressure then passes through conduit 16, the valve 18 and to and through the inlet 14, to be directed therefrom to power the turbine rotor and thereby drive the shaft 30 and the pinion 32. As the rotor comes up to its full speed, as determined by the applied pressure fluid, the pinion 32 meshes with and drives the engine flywheel 36 and crankshaft 38. As the engine flywheel is energized, to rotate from a position of rest, and the speed of its rotation increases, the speed pick-up device 52 scans the gear teeth 34 and, as each tooth thereof is recognized, sends a pulse indicative thereof to each of the speed switch 44 and the counter 50. The speed switch 44 refers the frequency of these pulses to its pre-set point reference and when the frequency indicates a speed of rotation of the engine flywheel equal to or exceeding the speed represented in said pre-set reference point, it induces an opening of the solenoid circuit. This results in a de-energization of the solenoid 40, producing thereby a closing of valves 28 and 18 and an interruption of the flow of gaseous fluid to power the starter. This interruption is brief since the output of the starter and the speed of rotation of the engine flywheel is responsively reduced rather quickly. As the speed pick-up device 52 senses the reduction in the speed of rotation of the flywheel 36 as it scans the teeth of the ring gear 34, the frequency of the signals transmitted to the speed switch thereby so indicate. Accordingly, the speed switch quickly recognizes when the speed of rotation of the flywheel has fallen below the prescribed limit and, resets and produces a closing of the circuit of the solenoid 40 and a re-energization thereof, which results in a corresponding opening of the valve 18 and a full flow of the gaseous fluid in the conduit 16 to power the turbine rotor of the starter.

Since, inherently, the rise in the speed of rotation of the engine flywheel, once power is applied, is relatively rapid, the limit of the speed of rotation of the flywheel is reached within a very few degrees of rotation of the flywheel and the crankshaft to which it drivingly relates. Consequently there a number of closely spaced interruptions of the flow of gaseous fluid to power the starter during a full 360° of rotation of the flywheel, at the end of which the override factor of the engines system is brought into play to nullify the ability of the circuitry of the speed switch to produce further interruptions. The effect of this is that during the initial portion of the starting procedure which constitutes the first step of the starting cycle of the invention there is a pulsed delivery of the gaseous fluid to power the starter and during the second step thereof, which comes into effect when the counter 50 signals a completion of the first step, there is full flow of the gaseous fluid to power the starter and the output thereof is sufficient to produce a rotation of the flywheel and the engine crankshaft at a level of speed to quickly start the engine.

As a matter of fact, in spite of the interruptions in the flow of gaseous fluid to the starter during the first step of the starting procedure, the output of the starter will not be fully interrupted, nor will the starter in fact shut down. Contrary to this, the starter will continue to have an output, though of a reducing nature, for the short period of time that elapses from the commencement of the interruption of the flow of gaseous fluid to the time of resumption thereof based upon the automatic operation of the invention system. The relatively slow speed at which the engine is initially cranked in the practice of the method of the invention and in the use of embodiments thereof essentially insures that within 360° of the flywheel rotation one may eliminate liquid from the engine cylinders to the degree there is no concern for hydraulic lock or damage to the engine on starting and at the same time insure that if there is any other problem in rotation it will in all likelihood expose itself before the engine is brought up to its full starting speed. By the same token, in the event, for some unforeseen reason, there should be a hydraulic or other blockage which interferes with the rotation of the flywheel and the crankshaft to which it drivingly relates during the first step of the starting cycle when the speed of rotation of the flywheel is relatively slow, there will be insufficient energy stored in the moving parts of the engine at this time to cause engine damage by reason of the blockage. At this time, the control circuit of the invention system will remain active even though rotation of the engine crankshaft cannot and will not take place. Under such circumstances, since the engine flywheel is not rotating, the counter in the control system will never receive enough pulses to cause the system to reach the second step of the starting cycle. There will be a continued pulsing of the system after the blockage occurs which will be readily recognized by the operator, who will then take the necessary steps to terminate the starting operation and take whatever action is necessary to eliminate the blockage. Thus, the control of the starting procedure as afforded by the present invention affords a simple but optimal protection of the apparatus involved, with obvious benefits to the user.

FIG. 2 of the drawings reveals an integrated control circuit which may be used for the starting of the diesel engine 10 in lieu of that described with reference to FIG. 1. There is little change in the contents or the operation of the circuitry of FIG. 2, as may be readily seen by one versed in the art. The description set forth with reference to the embodiment of FIG. 1, as to the elements of the control circuit and their function find their equivalents in the representations and the circuitry of FIG. 2. Therefore, since the application of the circuitry of FIG. 2 should be obvious to those versed in this particular art, to repetitively describe the elements and method of the invention with reference thereto would appear to serve no useful purpose. The essence of the invention and the features thereof, both in respect to method and apparatus, has been fully set forth in the foregoing description.

It should of course be obvious that there may be modification and variation in the embodiment and practice of the invention which are contemplated by and within the scope of the appended claims.

It is important to note that using the two cycle system for starting a diesel engine, as herein described, one can safely control initial cranking speed regardless of engine, engine load and variations in power supply. Also the device 52 can be any one of a variety of sensor devices such as, for example, "magnetic pickup LMPC" of Red Lion Controls of York, Pa.

As herein provided the control for a diesel engine, during starting, is precise, free of possibility of serious or harmful malfunction, versatile as to its application and particularly beneficial in application to large diesel engines.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A system for starting a diesel engine which includes a crankshaft for drive thereof comprising means to apply power to crank the crankshaft of said engine up to a speed which is required to start the engine, means for sensing the speed of rotation of said crankshaft as it rises toward that level of speed which is required for starting said engine and transmitting signals thereof, means receiving said signals operative to responsively control the amount of power applied to drive said crankshaft to prevent the speed of its rotation from exceeding a predetermined limit which is less than that required to start said engine and means to override said control means after a predetermined degree of rotation of said crankshaft, thereby to allow its speed to rise to the level required to produce a starting of the engine.

2. Apparatus as in claim 1 including a pneumatic starter powered by delivery thereto of gaseous fluid under pressure, said starter providing said means to apply power to crank said crankshaft, said control means comprising means for inducing a pulsed delivery of said gaseous fluid to power said starter, thereby limiting the application of power to said crankshaft to less than that required to start the engine until said crankshaft has been rotated a pre-set amount to induce the function of said override means to provide for a starting of said engine.

3. A system for starting a diesel engine as in claim 1 wherein said means to override said control means is operatively connected to said speed sensing means to receive signals therefrom each of which is representative of a predetermined degree of rotation of said crankshaft and is itself rendered operative to effect its override function by an accumulation of said signals the total of which represents approximately a 360° rotation of said engine crankshaft.

4. Apparatus as in claim 1 wherein said means to apply power to crank the crankshaft of said engine includes a pneumatic starter operatively connected with the engine having a conduit for delivery thereto of a gaseous fluid, under pressure, to furnish its motive power and provide therethrough the power applied to said crankshaft for starting the engine and said means to control the application of said power includes a valve for controlling the flow of said gaseous fluid and means operating said valve in an automatic response to the sensing of a particular speed of rotation of said crankshaft the level of which is less than that required for starting the engine to briefly interrupt the delivery of gaseous fluid to said starter until the speed of rotation of said crankshaft falls below said level.

5. A system for starting a diesel engine as in claim 1 wherein said control means includes means rendered operative to produce a very brief interruption of the power applied to drive said crankshaft each time the speed of its rotation reaches said predetermined limit to reduce the speed of its rotation and to produce a resumption of the application of said power each time the speed of rotation of said crankshaft falls below said predetermined limit.

6. A system as in claim 5 wherein said control means are constructed and arranged to establish said predetermined limit as approximately one quarter of the speed required for starting the engine.

7. A system for starting a diesel engine which includes a crankshaft comprising a pneumatic starter powered by a delivery thereto of a gaseous fluid under pressure, a valve which is normally closed being interposed to block the flow of the gaseous fluid to power said starter, means to open said valve to initiate the flow of said gaseous fluid to power said starter and effect therethrough a drive of said crankshaft to start said engine, means for sensing the speed of rotation of said crankshaft as it rises toward that level required to start said engine and to transmit signals thereof, control means operative to receive said signals and produce a brief closing of said valve when the speed of rotation of said crankshaft reaches a pre-set level, which is less than the speed of rotation thereof required to start the engine, said control means being constructed and arranged to respond to a falling of the speed of rotation of said crankshaft below said pre-set level to induce a re-opening of said valve, and means to preclude the function of said control means to close said valve upon the occurrence of a predetermined degree of rotation of said crankshaft sufficient to insure against malfunction of said engine upon its starting, which then follows.

8. Apparatus as in claim 7 wherein said means to preclude the function of said control means to close said valve upon the occurrence of a predetermined degree of rotation of said engine is a counter which receives said signals and is constructed and arranged to be rendered operative by the receipt of a particular number of said signals.

9. A method of starting a diesel engine which includes a crankshaft comprising applying power to said crankshaft to rotate it and take it from a position of rest up to the speed thereof required to start said engine, briefly interrupting the application of said power in each instance the speed of rotation of said crankshaft reaches a preset level which is less than that required for starting the engine, for a period sufficient to cause its speed of rotation to reduce below said level but insufficient to interrupt the rotation of said crankshaft until the extent of the crankshaft rotation has reached at least 360° and thereafter maintaining the application of said power for a time sufficient to bring the engine up to the speed required for starting thereof.

10. A method of starting a diesel engine having in connection therewith a pneumatic starter and means for the flow thereto of a gaseous fluid under pressure to furnish its motive power and provide said source of power to drive the engine as in claim 9 characterized in that the step of interrupting the application of said power is effected by a selective blocking of the flow of the gaseous fluid which furnishes the motive power for said pneumatic starter.

11. A method of starting a diesel engine as in claim 10 wherein the application of power and the interruption thereof is conducted in a manner to produce a pulsed application of said power during the occurrence of which to cause the speed of rotation of the crankshaft to rise to and decay to a limited extent from said preset level in repetitive fashion until the occurrence of a predetermined degree of rotation of said crankshaft sufficient to insure against malfunction of said engine upon its starting, which then follows.

12. A system for starting a diesel engine which includes a crankshaft for drive thereof comprising means to apply power to crank the crankshaft of said engine up to a speed which is required to start the engine, means for producing an automatically pulsed application of said power to crank the crankshaft of said engine through at least 360° while precluding the starting of the engine and means operative to terminate said pulsed application in an automatic response to the occurrence of a degree of rotation of said crankshaft sufficient to insure against malfunction of said engine upon its starting, which then follows.

* * * * *